US009314837B2

(12) United States Patent
Mitsutake et al.

(10) Patent No.: US 9,314,837 B2
(45) Date of Patent: Apr. 19, 2016

(54) METHOD FOR MOLDING SAND MOLD AND SAND MOLD

(71) Applicants: Masaomi Mitsutake, Toyota (JP); Hirotsune Watanabe, Miyoshi (JP); Tomokazu Suda, Okazaki (JP); Yusuke Kato, Toyokawa (JP); Toshihiko Zenpo, Toyokawa (JP)

(72) Inventors: Masaomi Mitsutake, Toyota (JP); Hirotsune Watanabe, Miyoshi (JP); Tomokazu Suda, Okazaki (JP); Yusuke Kato, Toyokawa (JP); Toshihiko Zenpo, Toyokawa (JP)

(73) Assignees: TOYOTA JIDOSHA KABUSHIKI KAISHA, Toyota-Shi (JP); SINTOKOGIO, LTD., Nagoya-Shi (JP)

( * ) Notice: Subject to any disclaimer, the term of this patent is extended or adjusted under 35 U.S.C. 154(b) by 177 days.

(21) Appl. No.: 14/360,577

(22) PCT Filed: Nov. 27, 2012

(86) PCT No.: PCT/IB2012/002501

§ 371 (c)(1),
(2) Date: May 23, 2014

(87) PCT Pub. No.: WO2013/080016

PCT Pub. Date: Jun. 6, 2013

(65) Prior Publication Data

US 2014/0284015 A1 Sep. 25, 2014

(30) Foreign Application Priority Data

Nov. 28, 2011 (JP) ..... 2011-259311

(51) Int. Cl.
*B22C 1/00* (2006.01)
*B22C 1/18* (2006.01)

(Continued)

(52) U.S. Cl.
CPC . *B22C 1/00* (2013.01); *B22C 1/188* (2013.01); *B22C 7/06* (2013.01); *B22C 9/02* (2013.01)

(58) Field of Classification Search
CPC ..... B22C 1/00; B22C 1/18; B22C 1/188; B22C 9/02
USPC ..... 164/37, 520, 522, 349; 106/38.27, 38.3, 106/38.9
See application file for complete search history.

(56) References Cited

U.S. PATENT DOCUMENTS

| | | | |
|---|---|---|---|
| 5,127,461 | A | 7/1992 | Matsunaga et al. |
| 6,139,619 | A | 10/2000 | Zaretskiy et al. |
| 2007/0066707 | A1 | 3/2007 | Zenpo et al. |

(Continued)

FOREIGN PATENT DOCUMENTS

| | | | |
|---|---|---|---|
| GB | 1279979 | A | 6/1972 |
| JP | 47-023320 | A | 10/1972 |

(Continued)

*Primary Examiner* — Kevin P Kerns
(74) *Attorney, Agent, or Firm* — Kenyon & Kenyon LLP

(57) ABSTRACT

By mixing, stirring and kneading, with water glass (11) as a binder, sand (7), a surfactant (9), and water (10), foamed sand (S) is generated. The foamed sand (S) is packed in a cavity of a metallic mold and solidified to form a sand mold. By using the sand mold, aluminum is cast. By using water glass that is an inorganic binder, during casting, harmful gas and odor are not generated. Further, when a molar ratio n of water glass (Na2O nSiO2 mH2O) is adjusted in the range of 0.65 to 1.30, a quantity of water (H2O) generated by heating water glass with a high temperature melt during casting can be suppressed. Thereby, hydrogen gas (H2) according to a reaction between water (H2O) and aluminum (Al) can be suppressed from being generated and casting quality can be improved.

8 Claims, 6 Drawing Sheets

(51) Int. Cl.
*B22C 9/02* (2006.01)
*B22C 7/06* (2006.01)

(56) References Cited

U.S. PATENT DOCUMENTS

| | | | | |
|---|---|---|---|---|
| 2010/0140823 | A1 | 6/2010 | Asano et al. | |
| 2010/0326620 | A1* | 12/2010 | Muller et al. | B22C 1/26 164/528 |

FOREIGN PATENT DOCUMENTS

| | | | |
|---|---|---|---|
| JP | 08-024996 | B2 | 3/1996 |
| JP | 09-239485 | A | 9/1997 |
| JP | 2001-047189 | A | 2/2001 |
| JP | 3891215 | B2 | 12/2006 |
| WO | 95/15229 | A1 | 6/1995 |
| WO | 2007-058254 | A1 | 5/2001 |

* cited by examiner

METHOD FOR MOLDING SAND MOLD AND SAND MOLD

CROSS-REFERENCE TO RELATED APPLICATIONS

This is a national phase application based on the PCT International Patent Application No. PCT/IB2012/002501 filed on Nov. 27, 2012, and Japanese Patent Application No. 2011-259311 filed on Nov. 28, 2011, the entire contents of which are incorporated herein by reference.

BACKGROUND OF THE INVENTION

1. Field of the Invention

The present invention relates to a method for molding a sand mold, in which sand is packed in a mold and solidified to mold a sand mold for casting, and a sand mold.

2. Description of the Related Art

When casting a cylinder block, a cylinder head, or the like of an engine, a collapsible sand core (sand mold) is used for forming a hollow part such as a water jacket, an intake and exhaust port, or the like. WO 2007/058254 describes a starch-based compound that is an organic substance is used as a binder, the binder is stirred and foamed together with an aggregate, a surfactant, a crosslinking agent and water to form foamed sand, and the foamed sand is solidified to mold a sand core for casting.

According to this, although the starch-based binder generates $CO_2$ and $H_2O$ when decomposed by heating with a high temperature melt during casting, it does not generate a harmful gas or an odor. Further, since the starch-based binder becomes collapsible owing to pyrolysis, also core sand can be easily ejected after casting.

However, as was described above, the binder is heated with a high-temperature melt during casting to generate $CO_2$ and $H_2O$; accordingly, in a casting metallic mold, a measure for exhausting these gases has to be applied.

SUMMARY OF THE INVENTION

The present invention provides a method for molding a sand mold and a sand mold, which can suppress a gas from being generated during casting and can improve casting quality.

A first aspect of the invention is a method for molding a sand mold, which uses sand for casting, a surfactant, water, and water glass, and the method includes a step of stirring the sand for casting, the surfactant, the water, and the water glass; a step of packing a sand mixture obtained according to the stirring into a sand mold-molding space; and a step of solidifying the packed sand mixture, herein a molar ratio of silicon dioxide with respect to sodium oxide in water glass is 0.65 to 1.30. Here, a molar ratio means, in a composition of water glass, a mixing ratio of silicon dioxide with respect to sodium oxide in terms of a ratio of the numbers of moles.

In the first aspect, the molar ratio may be set to 1.10 to 1.30. Further, in the above aspect, the molar ratio may be set to about 1.20.

In the first aspect, the method for molding a sand mold may be a method for molding a sand mold where the sand mold is molded of foamed sand obtained by stirring and foaming the water glass together with the sand for casting and the surfactant.

In the first aspect, the sand mold may be a sand mold for casting aluminum. Further, in the aspect, the sand mold may be a sand mold for low-pressure casting.

Further, according to a second aspect of the invention, in a sand mold configured of sand for casting, a surfactant, water, and water glass that is a binder, a molar ratio of silicon dioxide with respect to sodium oxide in the water glass is 0.65 to 1.30.

In the second aspect, the molar ratio may be set to 1.10 to 1.30. Further, in the above aspect, the molar ratio may be set to about 1.20.

In the second aspect, foamed sand obtained by stirring and foaming the water glass together with the sand for casting sand and the surfactant may be used to mold a sand mold. Further, in the second aspect, the sand mold may be a sand mold for casting aluminum. Further, in the second aspect, the sand mold may be a sand mold for low-pressure casting.

By using the sand mold or method for molding a sand mold according to the two aspects, when water glass is heated with a melt during casting, discharge of water becomes slight; accordingly, a gas can be suppressed from being generated and casting quality can be improved.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENTS

Figure 1:
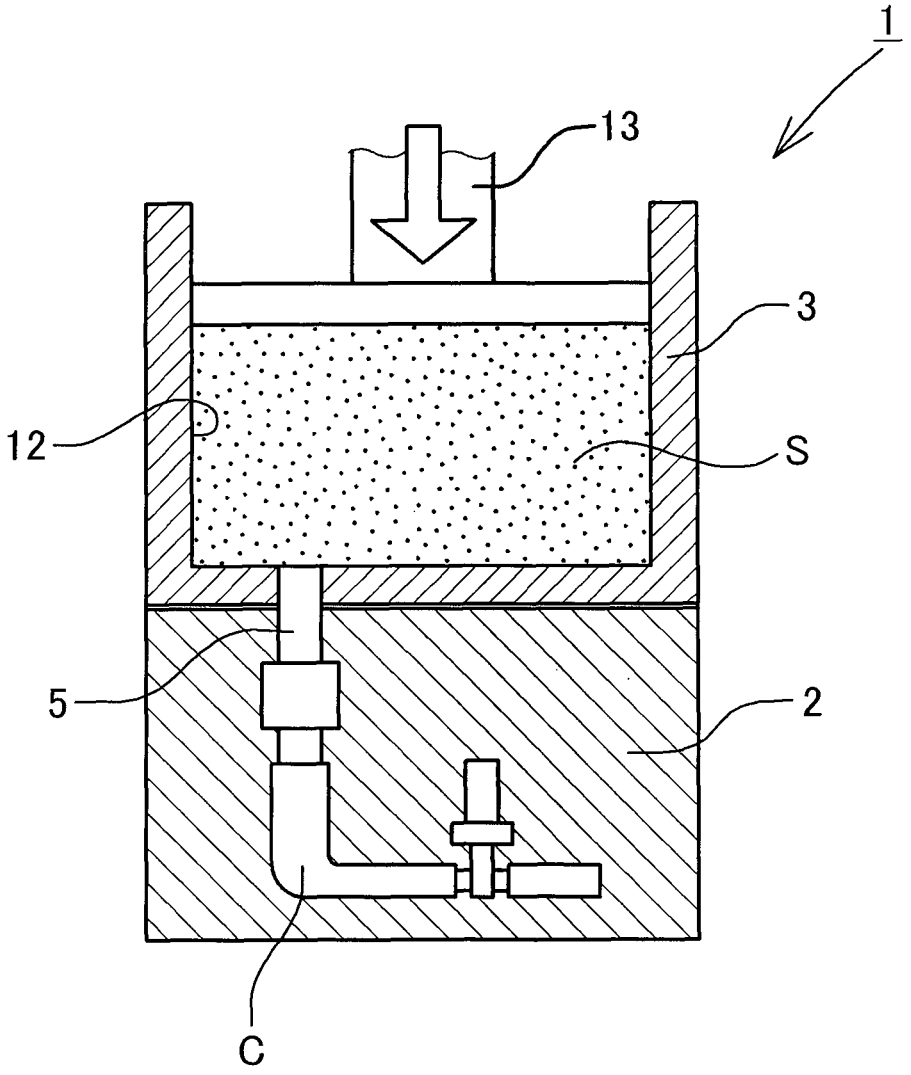
FIG. 1 is a vertical cross-sectional view showing a schematic configuration of a sand mold-molding device related to one embodiment of the invention.

Hereinafter, an embodiment of the invention will be detailed based on the drawings. A sand mold-molding device 1 for molding a sand mold related to the present embodiment is illustrated in FIG. 1. As illustrated in FIG. 1, the sand mold-molding device 1 is used to solidify foamed sand S to mold a sand core (sand mold) for casting aluminum, and includes a metallic mold 2 having a cavity C for molding a sand core and a packing device 3 for packing the foamed sand S in a cavity C of the metallic mold 2.

Figure 2A:
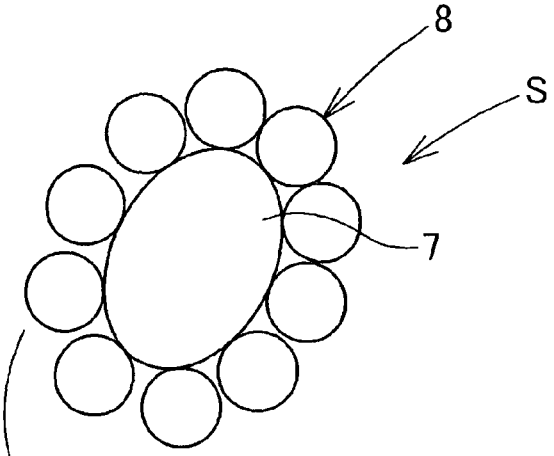
FIG. 2A and FIG. 2B each is an image diagram showing a composition of foamed sand that is used in a device shown in FIG. 1.
Figure 2B:
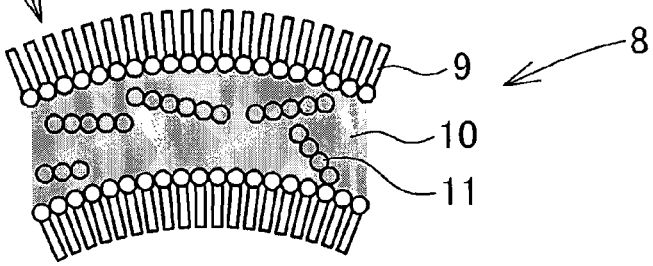

The foamed sand S being used in the embodiment is in a foamed state by mixing, stirring, and kneading sand that is an aggregate, with water glass (sodium silicate) as a binder, together with a composition containing water and a surfactant. An image of a state of a particle constituting the foamed sand S is illustrated in FIG. 2. FIG. 2A illustrates a state where foams 8 are adsorbed on a surface of a particle 7 of the sand, and FIG. 2B illustrates a partially enlarged state of a foam 8. As illustrated in FIG. 2B, in the foamed sand S, a surfactant 9 covers a surface of an aqueous solution of water glass (containing water: 10 and water glass: 11) to form a foam 8, and the foam 8 is absorbed on a surface of a particle 7 of sand via a surfactant 9 to form a foamed state and have proper viscosity. Here, with respect to sand, by setting a molar ratio of water glass (mixing ratio of silicon dioxide with respect to sodium oxide) to 0.5 to 3.0, a weight ratio thereof to 0.4 to 3.0%, a weight ratio of water to 1.5 to 5.0%, and a weight ratio of surfactant to about 0.003 to 2.0%, foamed sand S having appropriate viscosity can be obtained.

The metallic mold 2 forms a cavity C by clamping an upper mold and a lower mold. The metallic mold 2 is provided with a packing path 5 that communicates a cavity C and a sand bath 12 of a packing device 3. The packing device 3 includes a sand bath 12 that kneads foamed sand S and stores and a pressure mechanism 13 (pressurizing means) for pressurizing the foamed sand S in the sand bath 12. When the metallic mold 2 is set to the sand bath 12 and the foamed sand S in the sand bath 12 is pressurized with a pressurizing mechanism 13, the foamed sand S is packed in the cavity C of the metallic mold 2 via the packing path 5. The metallic mold 2 is heated to about 150° C. to 300° C., moisture of the foamed sand S packed in the cavity C is vaporized to solidify the foamed sand S. Thereafter, the metallic mold 2 is opened and a molded sand core is taken out.

Then, a composition of water glass that is a binder for generating foamed sand S of the embodiment will be described. Water glass ($Na_2O.nSiO_2.mH_2O$) is a mixture that contains silicon dioxide ($SiO_2$), sodium oxide ($Na_2O$) and water ($H_2O$), and, the characteristics vary depending on a molar ratio (n) where a mixing ratio of silicon dioxide to sodium oxide is expressed by a ratio of the number of moles. In general, when the molar ratio n is small, crystallites of water glass tend to precipitate in an aqueous solution; accordingly, the storage stability and the handling properties of the foamed sand S deteriorate and also the strength of molded sand core (sand mold) deteriorates.

Figure 3:
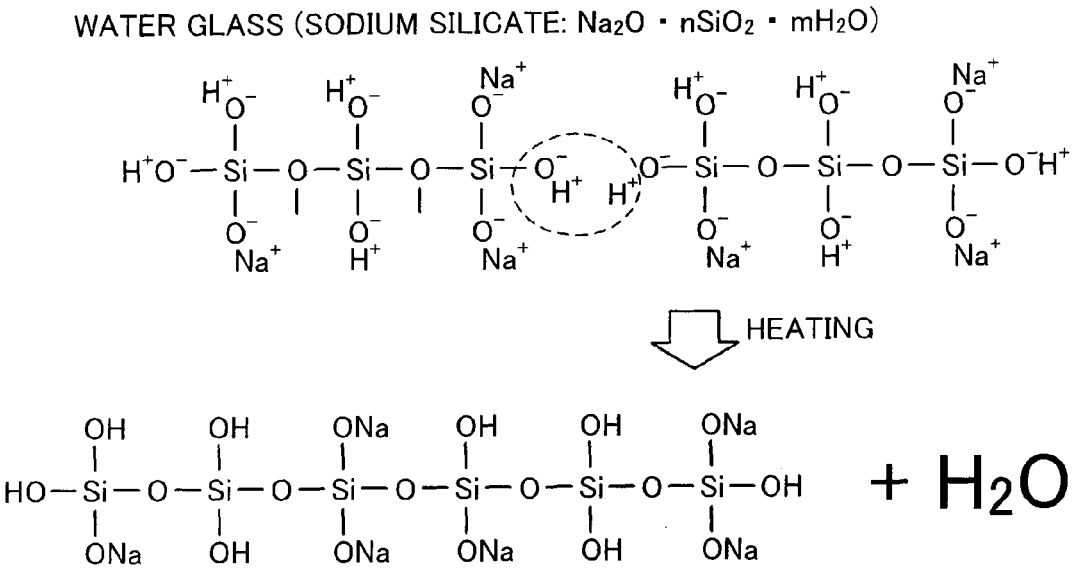
FIG. 3 is an explanatory diagram showing a reaction that generates $H_2O$ by heating water glass that is a binder.
Figure 4A:
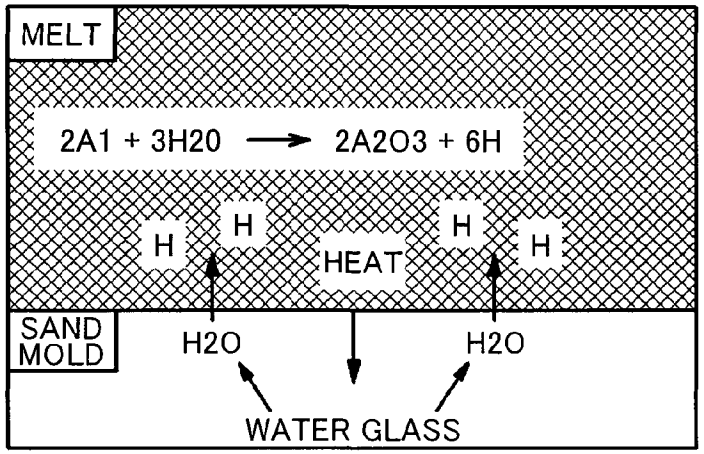
FIG. 4A and FIG. 4B each is an explanatory diagram showing a process where a defect is generated on a superficial layer of cast metal by $H_2O$ generated by heating a binder during casting.
Figure 4B:
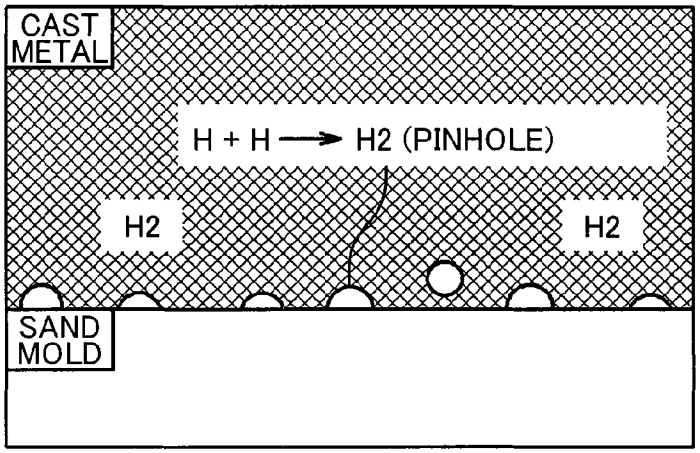

As shown in FIG. 3, when heated at a high temperature, water glass ($Na_2O.nSiO_2.mH_2O$) causes a reaction between molecules to isolate water ($H_2O$). Accordingly, as shown in FIG. 4A, in the aluminum casting, when a sand mold which is molded with water glass as a binder comes into contact with an aluminum melt at high temperature during casting, water glass is heated to discharge water ($H_2O$), the water reacts with aluminum (Al) at high temperature to generate aluminum oxide ($Al_2O_3$) and hydrogen (H). At this time, hydrogen dissolves in the melt. However, when a large quantity of hydrogen (H) is generated, as shown in FIG. 4B, supersaturated hydrogens form hydrogen gas ($H_2$) and precipitate, many defects such as many pinholes and so on are formed on a superficial layer of cast metal to cause casting failure.

Since the foamed sand S that is packed inside the cavity C of the metallic mold 2 and solidified becomes high in internal pressure owing to foams, a binder and sand are condensed on an internal wall side with respect to a center portion of the cavity C, that is, on an outside portion of a sand core to be molded. As a result, a large quantity of water glass is present on a superficial portion of the sand core that comes into contact with the melt during casting, water ($H_2O$) tends to be readily separated by heating, and hydrogen gas ($H_2$) tends to be readily generated. In particular, in the low pressure casting where a solidification time is long, defects owing to generation of hydrogen gas becomes problematic.

Figures 6A, 6B, 6C:
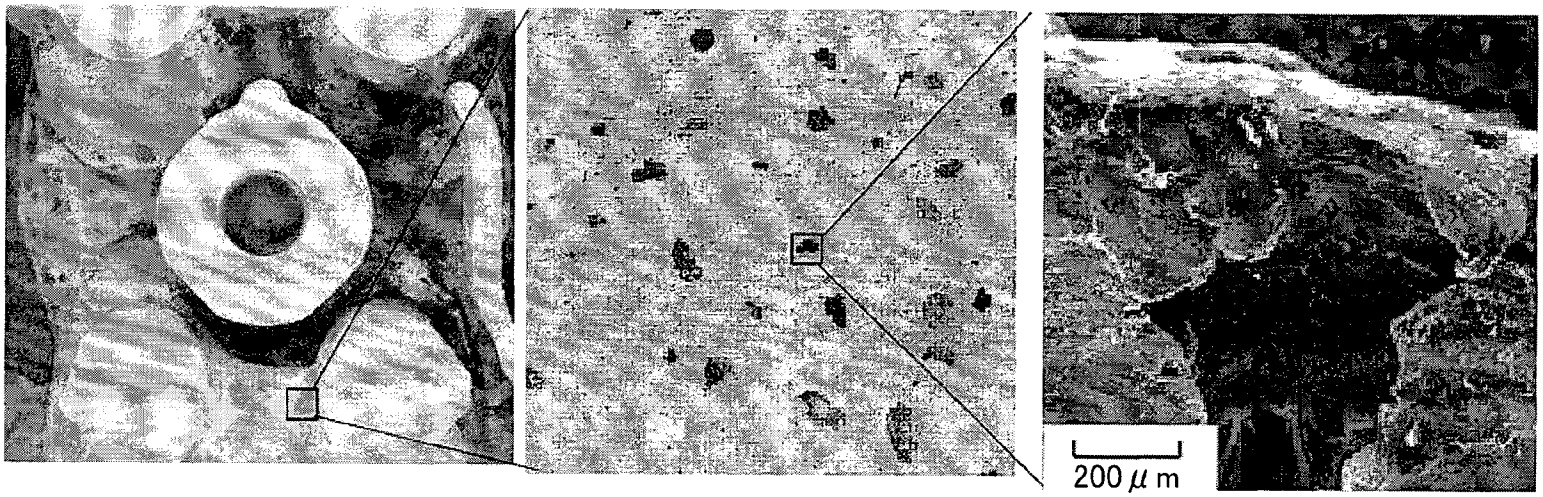
FIG. 6A, FIG. 6B and FIG. 6C each is a diagram showing a defect generated on a superficial layer of cast metal by $H_2O$ generated by heating a binder during casting.

A state of defects generated on a superficial layer of a cast metal owing to hydrogen gas generated during casting in the aluminum low-pressure casting is shown in FIG. 6. FIG. 6A illustrates a state of distribution of defects (black spots) generated on a superficial layer of a cast metal, and FIG. 6B shows a micrograph obtained by enlarging a defect portion. Further, FIG. 6C shows a scanning electron micrograph (SEM) obtained by enlarging the inside of a defect. As illustrated in FIG. 6A to FIG. 6C, the defect is dendrite generated inside of a superficial portion of the cast metal. From this, it is found that when water glass comes into contact with an aluminum melt at high temperature during casting, water is isolated, the water reacts with aluminum to generate hydrogen, and supersaturated hydrogens form hydrogen gas to generate defects on a superficial layer of a cast metal.

Figure 5:
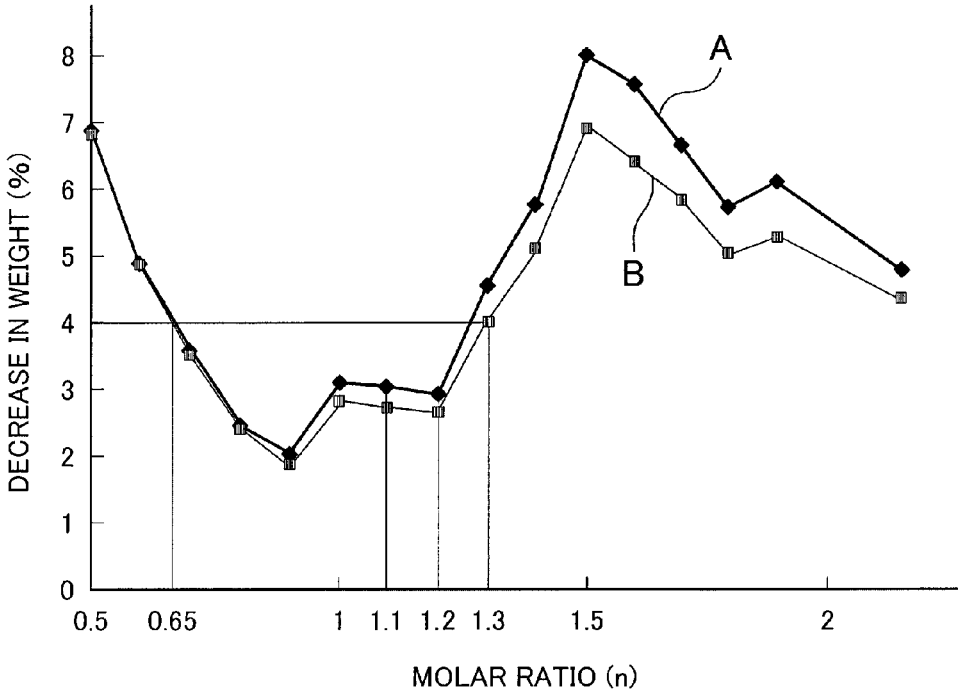
FIG. 5 is a graph showing a relationship between a molar ratio of a composition of water glass that is a binder and a decrease in weight by heating.

Then, a relationship between a Molar ratio of water glass (n) and a quantity of water ($H_2O$) separated by heating will be described with reference to FIG. 5. By heating water glasses having different molar ratios (n) (molar ratio n=0.5 to 2.1), each of weights of isolated water was measured as a decrease in weight of water glass, and results are shown in FIG. 5. In FIG. 5, a curve A shows a case where water glass was heated from 200° C. to 700° C., and a curve B shows a case where water glass was heated from 300° C. to 700° C. As illustrated in FIG. 5, in the range of molar ratio of n=0.65 to 1.30, a decrease in weight (quantity of generated water) decreases to 4% or less. Accordingly, when water glass having the molar ratio in the range of n=0.65 to 1.30 is used as a binder to mold a sand mold, and aluminum is cast, water can be suppressed from generating during casting. As a result, by suppressing hydrogen gas from generating, and thereby, by suppressing defects such as pinholes and so on from being generated, excellent aluminum cast metal can be obtained.

Further, when the molar ratio is preferably set in the range of n=1.10 to 1.30, since hydrogen gas can be suppressed from generating, and water glass crystal is suppressed from precipitating in an aqueous solution, storage stability and handling property of sand are enhanced and strength of a molded sand mold and collapsible property of sand mold after casting can be enhanced. According to the present embodiment, by considering the suppression of generation of hydrogen gas, strength of sand mold, and storage property and handling property of the sand, a molar ratio (n) of water glass is set to about 1.20.

When aluminum is cast by using a sand mold that is molded with water glass of which molar ratio is adjusted like this as a binder, casting quality can be improved without generating harmful gas and odor during casting, further, by suppressing hydrogen gas from generating. Further, sand that is difficult to precipitate crystal of water glass in an aqueous solution and excellent in the storage stability and handling property, has sufficient strength after molding, and is excellent in the collapsing property after casting can be obtained.

In the above embodiment, as an illustration, a case where a sand core for casting aluminum is molded is described. However, the invention can be applied similarly to molding other sand molds without restricting to a sand core. Further, although the invention is particularly suitable for the low pressure casting where a solidification time is long, and defects owing to generation of hydrogen gas tend to be problematic, the invention can be applied also to other casting methods. Still further, the invention may be applied to other casting sand molds without restricting to the aluminum casting, and, without restricting to foamed sand, can be applied to wet sand that is not foamed.

The invention claimed is:

1. A method for molding a sand mold, which uses sand for casting, a surfactant, water, and water glass, the method comprising:

stirring the sand for casting, the surfactant, the water, and the water glass;

packing a sand mixture obtained by stirring into a space for molding a sand mold; and solidifying the packed sand mixture;

wherein a composition of the water glass is set to 0.65 to 1.30 in terms of a molar ratio of silicon dioxide with respect to sodium oxide in water glass.

2. The method for molding a sand mold according to claim 1, wherein the molar ratio is set to 1.10 to 1.30.

3. The method for molding a sand mold according to claim 1, wherein, in the stirring, foamed sand obtained by stirring and foaming the water glass together with the sand for casting and the surfactant is used to mold the sand mold.

4. The method for molding a sand mold according to claim 1, wherein the sand mold is a sand mold for casting aluminum.

5. A sand mold comprising:

sand for casting, a surfactant, water, and water glass that is a binder, wherein a molar ratio of silicon dioxide with respect to sodium oxide in the water glass is 0.65 to 1.30.

6. The sand mold according to claim 5, wherein the molar ratio is set to 1.10 to 1.30.

7. The sand mold according to claim 5, wherein the sand mold is molded with foamed sand obtained by stirring and foaming the water glass together with sand for casting and the surfactant.

8. The sand mold according to claim 5, wherein the sand mold is a sand mold for casting aluminum.

* * * * *